US006588891B1

(12) United States Patent
Steven et al.

(10) Patent No.: US 6,588,891 B1
(45) Date of Patent: Jul. 8, 2003

(54) FILTER FOR USE IN AN INKJET PRINTER

(75) Inventors: Nicholas Iain McDonald Steven, Hants (GB); Merilyn Louise Murphy, Sussex (GB); Kevin Michael Quigley, Surrey (GB)

(73) Assignee: Domino Printing Sciences PLC (GB)

( * ) Notice: Subject to any disclaimer, the term of this patent is extended or adjusted under 35 U.S.C. 154(b) by 159 days.

(21) Appl. No.: 09/705,006

(22) Filed: Nov. 2, 2000

(30) Foreign Application Priority Data

Nov. 4, 1999 (EP) ..... 99308793

(51) Int. Cl.[7] ..... B41J 2/175
(52) U.S. Cl. ..... 347/93
(58) Field of Search ..... 347/93, 92, 86

(56) References Cited

FOREIGN PATENT DOCUMENTS

JP 54-151037 * 11/1979 ..... 347/92

* cited by examiner

*Primary Examiner*—Judy Nguyen
(74) *Attorney, Agent, or Firm*—Robert F. I. Conte; Barnes & Thornburg

(57) ABSTRACT

A common problem in vertical inkjet printers is that an air bubble is formed within the filter and so preventing correct operation of the printhead. Accordingly, a filter for use in an inkjet printer has a housing having an inlet and an outlet, with a filter element which is tapered towards the outlet for, in use, removing unwanted substances from ink flowing through the housing. A bleed tube has an inlet on the inlet side at the tapered end of the filter element, for removing trapped air from the inlet side of the filter element.

9 Claims, 1 Drawing Sheet

FILTER FOR USE IN AN INKJET PRINTER

This invention relates to an ink filter for use in an inkjet printer and, in particular, to a filter which removes trapped air from inside the inkjet printhead.

It is desirable for some printers to be able to print graphics or text on vertical surfaces, such as sides of transit cases and the like, and in order to achieve this, a multi-nozzle inkjet printhead must be orientated such that each of the nozzles or groups of nozzles within the head are vertically aligned above the other. Each nozzle or group within the printhead may have its own ink inlet and associated filter element, particularly when the printer uses hot-melt ink.

Figure 1:
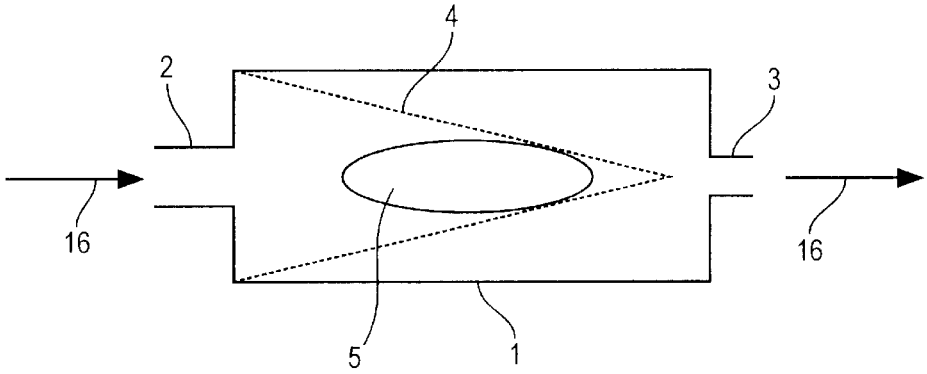
FIG. 1 PRIOR ART

Such a filter element is shown in FIG. 1 in which a filter housing 1 is provided with an inlet two and an outlet 3. A filter element 4, such as a filter mesh, is provided within the filter housing 1 and between the inlet 2 and the outlet 3.

Whilst such an arrangement is beneficial in allowing a comparatively high surface area of filter material in a relatively small housing, an unwanted side effect is that, as the filter mesh is formed in an approximately conical shape, air bubbles 5 may be created as described below. The air bubbles become trapped in the filter, on one side by the filter mesh 4 and on the other side by the flow of ink 16.

The capillary action of the ink in the pores of the filter mesh results in the filter mesh having a "burst pressure", i.e. a pressure below which air cannot be forced through the mesh. With fine filters as commonly used in inkjet printheads, this burst pressure is significant. Accordingly, as ink, but not air, can flow across the mesh, small bubbles of air coalesce to produce an air bubble trapped as shown in FIG. 1. This is a particular problem for drop-on-demand printheads as it prevents the ink feeds to the head from being properly primed. The present invention is aimed at overcoming this problem.

According to the present invention, there is provided a filter for use in an inkjet printer comprising:

a housing having an inlet and an outlet;

a filter element tapered towards the outlet for, in use, removing unwanted substances from ink flowing through the housing; and a bleed tube, having an inlet disposed on the inlet side at the tapered end of the filter element, for removing trapped air from the inlet side of the filter element.

Thus, the present invention provides a filter in which any trapped air can be quickly and simply removed such that the ink feeds to the inkjet printhead is not interrupted.

The filter element may be conical, hemispherical, frusto-conical, pyramidal or wedge-shaped.

Preferably the bleed tube enters the filter housing upstream of the filter through the fluid inlet.

Alternatively, the filter housing may be provided with an additional opening through which the bleed tube extends to remove unwanted air.

The bleed tube may be vented to the atmosphere or the system may be purged by applying a positive pressure to the bulk ink inlet or a negative pressure to the bleed tube. The use of the bleed tube provides an escape route for the trapped gas bubbles and this greatly improves the priming effectiveness of the printhead.

Figure 2:
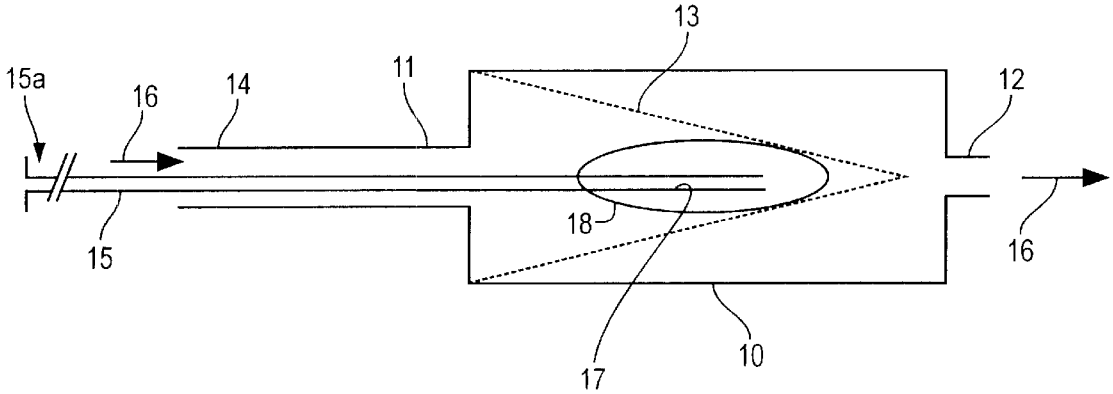

An embodiment of the present invention will be described with reference to the accompanying drawings in which:

FIG. 1 is a schematic cross sectional view of a filter according to the prior art; and FIG. 2 is a schematic cross sectional view of a filter according to the present invention.

As shown in FIG.2, a filter housing 10 is provided with an inlet 11 and an outlet 12. A tapered filter mesh 13 is provided across the inside of the housing between the inlet and the outlet. The inlet 11 is connected to a large bore tube 14 which is in fluid communication with the main ink reservoir (not shown). A bleed tube 15 is provided through the large bore tube 14 and the inlet 11 and extends into the filter housing on the upstream side of the filter mesh 13. Alternatively, the bleed tube 15 may extend into the housing through a separate opening 20. The flow of ink through the filter is indicated by arrows 16. The bleed tube 15 is provided with an inlet 17 which is located, in use, adjacent to the most downstream part of the filter mesh but on the inlet side thereof. The inlet 17 is placed in a region which contains an air bubble 18 and by connecting a part 15*a* of this tube 15 to either the atmosphere or to a negative pressure source (not shown), the air bubble and unwanted substances maybe expelled from the filter housing 10. Alternatively, a positive pressure may be applied to the large bore tube 14 and this in turn will force the excess air and unwanted substances out of the bleed tube 15.

Figure 3:
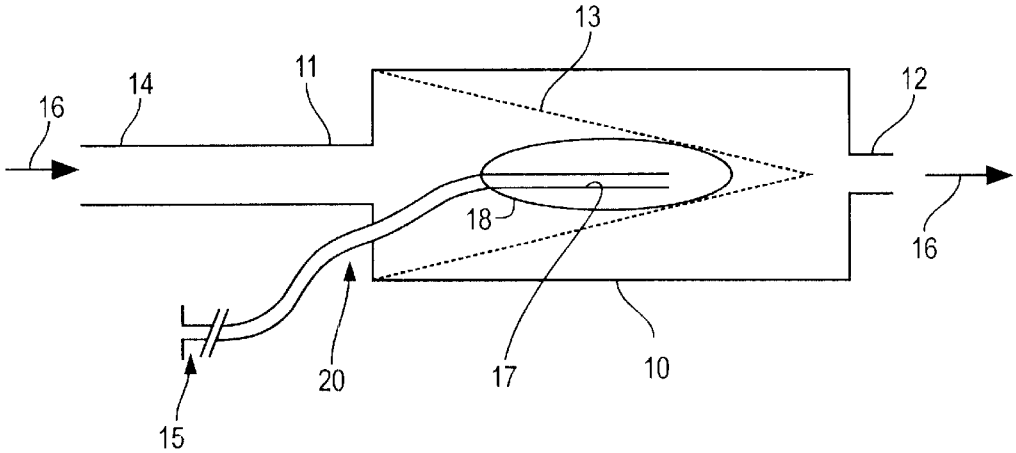

FIG. 3 is a schematic cross sectional view of an alternative embodiment of a filter according to the present invention.

It will be appreciated by persons skilled in the art, that numerous variations and/or modifications may be made to the invention as shown in the specific embodiment, without departing from the spirit or scope of the invention as broadly described. The present embodiment is, therefore, to be considered in all respects as illustrative and not restrictive.

What is claimed is:

1. A filter for use in an inkjet printer comprising:

a housing having an ink inlet and an ink outlet;

a filter element tapered towards the outlet for, in use, removing unwanted substances from ink flowing through the housing: and a a bleed tube extending into the housing and having an inlet disposed on the inlet side at the tapered end of the filter element, for removing trapped air from the inlet side of the filter element.

2. A filter according to claim 1, wherein the filter element is conical, hemispherical, frusto-conical, pyramidal or wedge-shaped.

3. A filter according to claim 1, wherein the bleed tube is inserted to the housing through the ink inlet.

4. A filter according to claim 1, wherein the bleed tube is inserted into the filter housing through an opening separate from said ink inlet.

5. A filter according to claim 1, wherein the bleed tube is vented to atmospheric pressure.

6. A filter according to claim 1, wherein any unwanted substances are forced through the bleed tube by positive pressure to a bulk ink supply through said ink inlet.

7. A filter according to claim 1, wherein any unwanted substances are forced through the bleed tube by negative pressure applied to the bleed tube.

8. A filter according to claim 2, wherein the bleed tube is inserted to the housing through the ink inlet.

9. A filter according to claim 2, wherein the bleed tube is inserted into the filter housing through an opening separate from said ink inlet.

* * * * *